US012055152B1

(12) United States Patent
Miny et al.

(10) Patent No.: US 12,055,152 B1
(45) Date of Patent: Aug. 6, 2024

(54) IN A TURBOMACHINE, ROTOR STRUCTURE WITH SEAL ASSEMBLY AND METHOD IN CONNECTION WITH SAME

(71) Applicant: SIEMENS ENERGY GLOBAL GMBH & CO. KG, Munich (DE)

(72) Inventors: Kevin Miny, Essen (DE); Marcus Meyer, Duisburg (DE); Martin Reimann, Essen (DE); Mark J. Kuzdzal, Allegany, NY (US); David J. Peer, Smethport, PA (US); Christian Kirchner, Rheinberg (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 18/686,034

(22) PCT Filed: Oct. 6, 2021

(86) PCT No.: PCT/US2021/053739

§ 371 (c)(1),
(2) Date: Feb. 23, 2024

(87) PCT Pub. No.: WO2023/059321

PCT Pub. Date: Apr. 13, 2023

(51) Int. Cl.

| | |
|---|---|
| ***F04D 27/00*** | (2006.01) |
| ***F04D 29/053*** | (2006.01) |
| ***F04D 29/12*** | (2006.01) |
| ***F04D 29/26*** | (2006.01) |
| *F04D 17/10* | (2006.01) |
| *F04D 29/08* | (2006.01) |

(52) U.S. Cl.
CPC ..... *F04D 27/001* (2013.01); *F04D 29/053* (2013.01); *F04D 29/122* (2013.01); *F04D 29/266* (2013.01); *F04D 17/10* (2013.01); *F04D 29/083* (2013.01)

(58) Field of Classification Search
CPC .... F04D 27/001; F04D 29/053; F04D 29/122; F04D 29/266; F04D 17/10; F04D 29/083
See application file for complete search history.

(56) References Cited

U.S. PATENT DOCUMENTS 3,801,217 A 4/1974 Ryall et al.
5,412,977 A * 5/1995 Schmohl ..... F04D 27/0292 277/318

(Continued)

FOREIGN PATENT DOCUMENTS

JP 2006138255 A 6/2006

OTHER PUBLICATIONS

PCT International Search Report and Written Opinion of the International Searching Authority mailed Jun. 27, 2022 corresponding to PCT Application No. PCT/US2021/053739 filed Oct. 6, 2021.

*Primary Examiner* — Sabbir Hasan
*Assistant Examiner* — Andrew J Marien
(74) *Attorney, Agent, or Firm* — Enrique J. Mora

(57) ABSTRACT

A compressor rotor for turbomachinery, such as a centrifugal compressor, is provided. Disclosed embodiments include a tie bolt and a rotor shaft that cooperates with the tie bolt to define a chamber therebetween. A seal assembly is positioned to separate the chamber from a first space and a leak detector in fluid communication with the first space and operable to generate a signal indicative of leakage of a fluid from the chamber to the first space.

23 Claims, 6 Drawing Sheets

(56) References Cited

U.S. PATENT DOCUMENTS

| | | | | |
|---|---|---|---|---|
| 2003/0017878 | A1* | 1/2003 | Muju | F16D 1/033 464/157 |
| 2011/0262284 | A1* | 10/2011 | Guernard | F04D 17/122 29/428 |
| 2016/0319820 | A1* | 11/2016 | Venkatachalam | F04D 29/054 |
| 2020/0166046 | A1 | 5/2020 | Griffin | |
| 2021/0262481 | A1* | 8/2021 | Kasatani | G01M 3/2853 |
| 2023/0125483 | A1* | 4/2023 | Reimann | F04D 29/083 416/183 |
| 2023/0193920 | A1* | 6/2023 | Miny | F04D 17/122 416/204 R |

* cited by examiner

IN A TURBOMACHINE, ROTOR STRUCTURE WITH SEAL ASSEMBLY AND METHOD IN CONNECTION WITH SAME

BACKGROUND

Disclosed embodiments relate generally to the field of turbomachinery, and, more particularly, to a rotor structure in a turbomachine, such as a compressor, and, even more particularly, to a rotor structure with a seal assembly and method in connection with same.

Turbomachinery is used extensively in many industries, such as for performing compression of a process fluid, conversion of thermal energy into mechanical energy, fluid liquefaction, etc. One example of such turbomachinery is a compressor, such as a centrifugal compressor.

DETAILED DESCRIPTION

Figure 1:
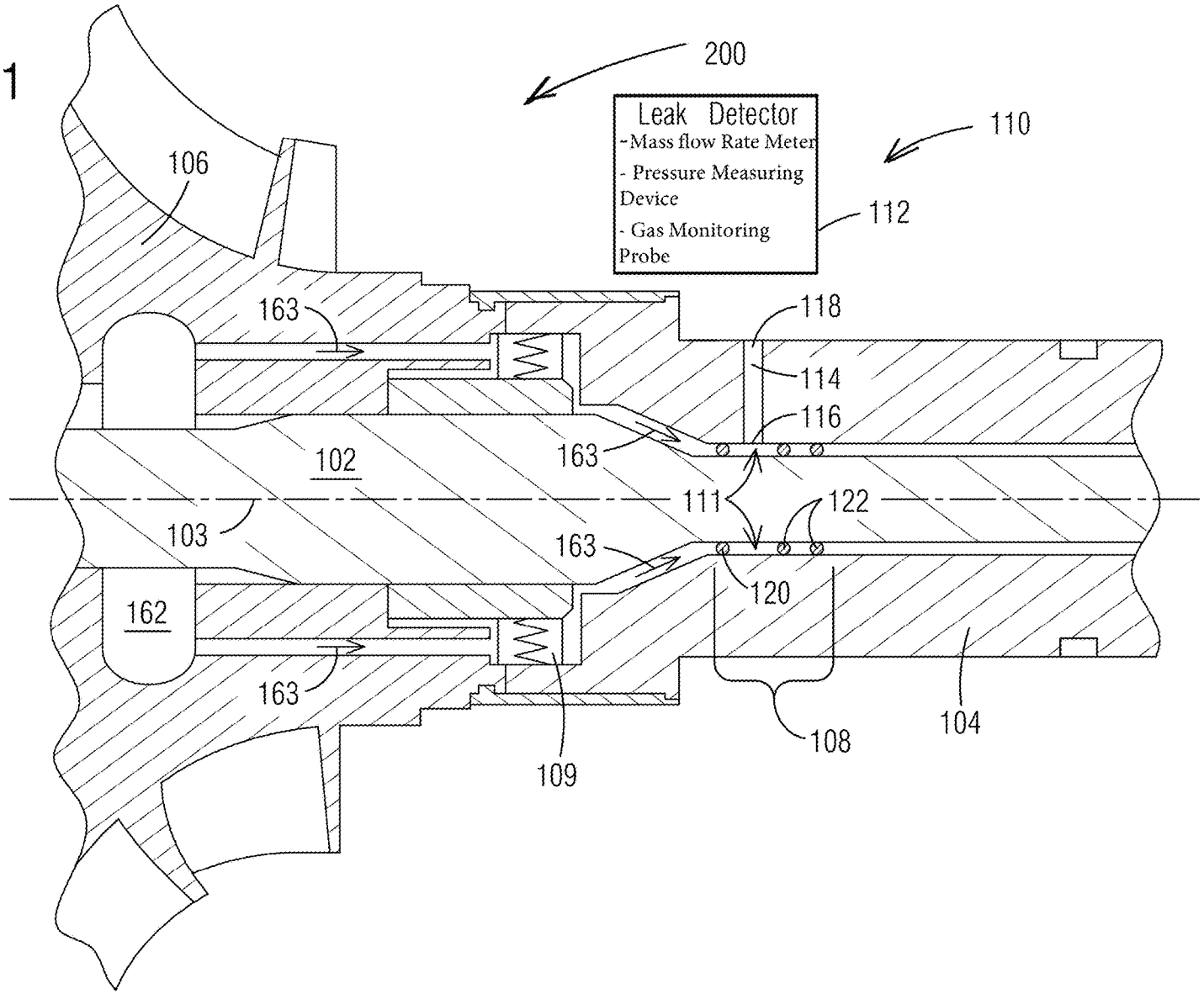
FIG. 1 illustrates a fragmentary, cross-sectional view of one non-limiting embodiment of a disclosed rotor structure.

As would be appreciated by those skilled in the art, turbomachinery, such as centrifugal compressors, may involve rotors of tie bolt construction (also referred to in the art as thru bolt or tie rod construction), where the tie bolt supports a plurality of impeller bodies and where adjacent impeller bodies may be interconnected to one another by way of elastically averaged coupling techniques, such as involving Hirth couplings or curvic couplings. These coupling types use different forms of face gear teeth (straight and curved, respectively) to form a robust coupling between two components. It will be appreciated that disclosed embodiments may be practiced with pins, tabs or any other mechanical connection that can transmit torque between adjacent rotor components. That is, disclosed embodiments are not limited to Hirth couplings or curvic couplings.

These couplings and associated structures may be subject to greatly varying forces (e.g., centrifugal forces), such as from an initial rotor speed of zero revolutions per minute (RPM) to a maximum rotor speed, (e.g., as may involve tens of thousands of RPM). Additionally, these couplings and associated structures, for example, may define interior cavities in the rotor that may be exposed to contaminants and/or byproducts that may be present in process fluids processed by the compressor. In applications where toxic chemical compounds are part of the process fluid, leakage of process fluid from the rotor into the atmosphere must be appropriately inhibited.

At least in view of the foregoing considerations, the present inventors have recognized that attaining consistent high performance and long-term durability in turbomachinery, such as a centrifugal compressor, may involve appropriately sealing and guiding safely out of the rotor process fluid that may leak into the rotor during operation of the compressor.

Disclosed embodiments may, without limitation, be implemented in turbomachinery that involves a stepped tie bolt, where respective ends of the tie bolt may extend into an atmospheric pressure side of the turbomachinery. Disclosed embodiments are designed to, in a cost-effective and reliable manner, prevent process fluid, which may leak into the rotor and may flow along the tie bolt from leaking out of the rotor end to the atmosphere.

In the following detailed description, various specific details are set forth in order to provide a thorough understanding of such embodiments. However, those skilled in the art will understand that disclosed embodiments may be practiced without these specific details that the aspects of the present invention are not limited to the disclosed embodiments, and that aspects of the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

FIG. 1 illustrates a fragmentary cross-sectional view of one non-limiting embodiment of a disclosed rotor structure 200 for a turbomachine, such as a compressor, where a tie bolt 102 supports an impeller body 106. It will be appreciated that for simplicity of illustration just one impeller body is shown in FIG. 1; however, impeller body 106 is typically one of a plurality of impeller bodies supported by tie bolt 102. Impeller body 106 is mechanically coupled by way of a hirth coupling 109 to a rotor shaft 104. In one non-limiting embodiment, rotor shaft 104 cooperates with tie bolt 102 to define a chamber 111 that may be located between tie bolt 102 and rotor shaft 104. In one non-limiting embodiment, a seal assembly 108 is positioned to separate chamber 111 from a first space 110. In one non-limiting embodiment, a leak detector 112 may be in fluid communication with first space 110 and is operable to generate a signal indicative of leakage of a fluid from chamber 111 to first space 110.

In one non-limiting embodiment, rotor shaft 104 may define a conduit 114 through rotor shaft 104. Conduit 114 may be fluidly connected to chamber 111 to pass the fluid to, for example, first space 110. In one non-limiting embodiment, the conduit 114 through rotor shaft 104 has a first opening 116 at a radially-inward surface of rotor shaft 104 to provide fluid communication with chamber 111. Conduit 114 has a second opening 118 at a radially-outward surface of rotor shaft 104 to provide an outlet to the fluid.

As may be appreciated in FIG. 1, one or more cavities 162 may be disposed about the tie bolt 102 along a rotor axis 103. During operation of the compressor, a process fluid (e.g., fluid being compressed in a pressurized process side of the compressor) may leak into cavity 162 and, by way of conduits, clearance gaps, spaces etc., that may form about the tie bolt, a flow of the fluid can form toward a lower pressure location. This flow may be schematically represented by arrows 163 in FIG. 1.

One non-limiting functionality that may be provided by seal assembly 108 is to inhibit the flow of the fluid to, for example, an atmospheric pressure side of the compressor. Another non-limiting functionality that may be provided by seal assembly 108 (e.g., in conjunction with conduit 114) is to guide the flow of the fluid to a desired location (e.g., first space 110), where the leakage can be detected, such as by way of leak detector 112. This latter functionality is utilized in the event there is a breach, for example, in a first O-ring 120 of seal assembly 108 that allows the fluid to pass into chamber 111 and in turn to conduit 114.

In one non-limiting embodiment, seal assembly 108 comprises first O-ring 120 circumferentially disposed about rotor shaft 104. The first O-ring 120 may be disposed at a first pressure side of chamber 111. In this non-limiting embodiment, seal assembly 108 further comprises a second O-ring 122 (and optionally may include further O-rings 122) circumferentially disposed about rotor shaft 104. The second O-ring 122 may be disposed at a second pressure side of chamber 111. The first pressure side of chamber 111 (e.g., the side to which the first O-ring 120 is exposed to) may be at a higher pressure compared to the second pressure side of chamber 111 (e.g., the side to which second O-ring 122 is exposed to). By way of example, the first pressure side of chamber 111 may correspond to the pressurized process side of the compressor and the second pressure side of chamber 111 may correspond to the atmospheric pressure side of the compressor.

Figure 2:
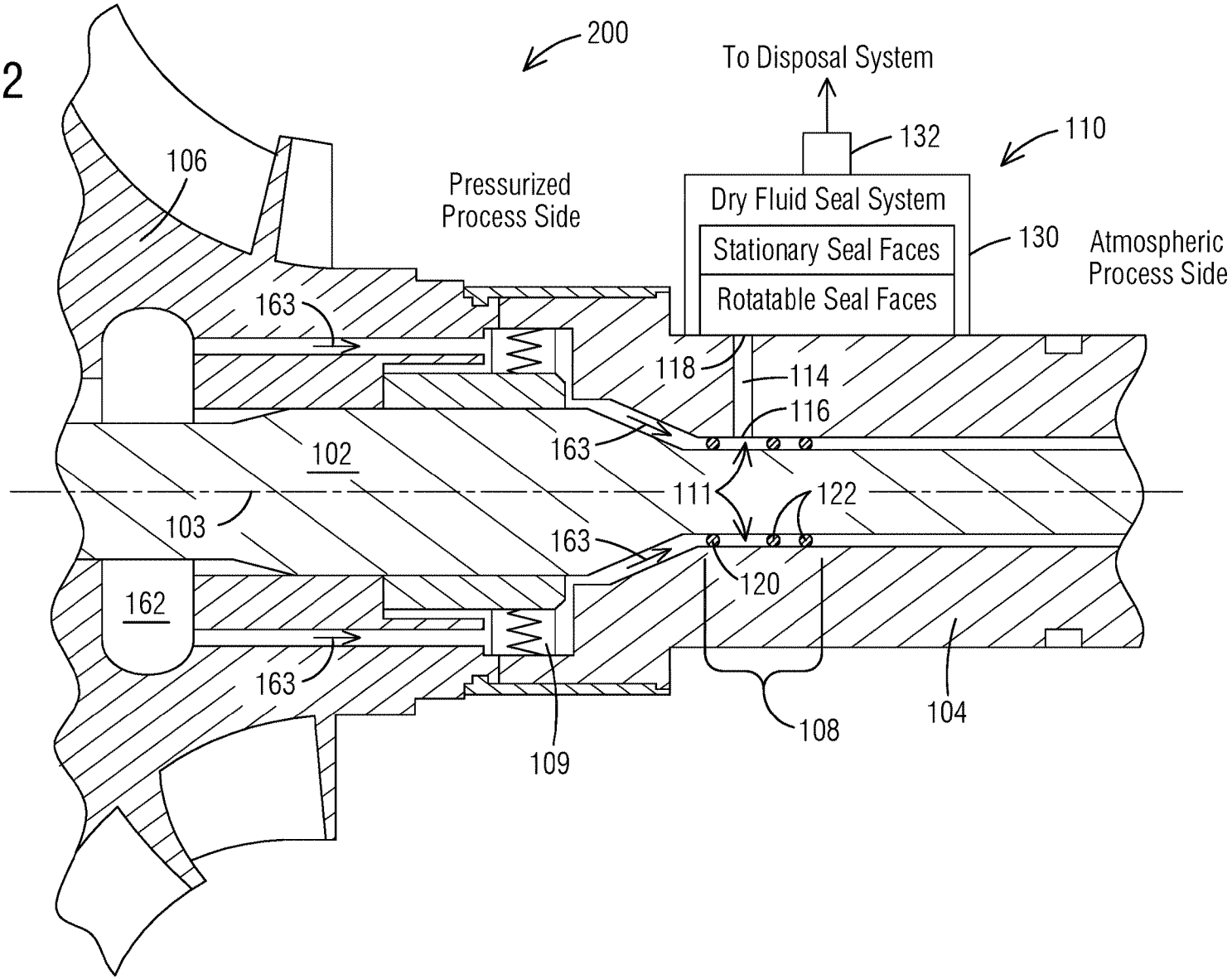
FIGS. 2 through 3 may be used for illustrating and describing certain non-limiting structural and/or operational relationships that may be realized in connection with the embodiment shown in FIG. 1 in combination with a dry fluid seal system.
Figure 3:
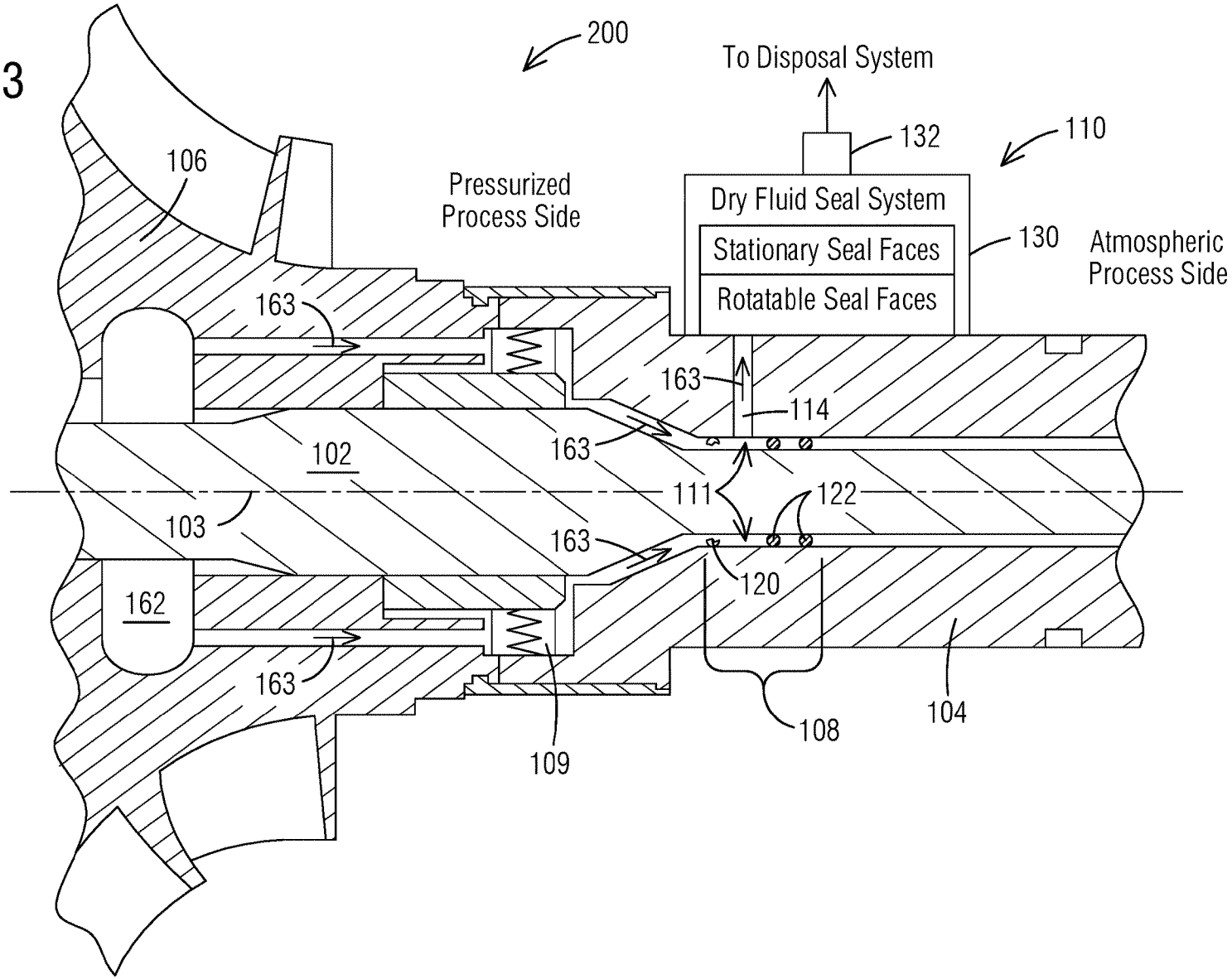

In one non-limiting embodiment, as shown in FIGS. 2 and 3, a dry fluid seal system 130 may be interconnected to provide a vent outlet to conduit 114. As would be appreciated by one skilled in the art, dry fluid seal systems are typically used in process gas centrifugal compressors to separate the pressurized process side of the compressor from the atmospheric side of the compressor. Certain disclosed embodiments permit a cost-effective and innovative integration of one example embodiment of a disclosed seal assembly with a dry fluid seal system to more effectively deal with leakage of fluid that otherwise could detrimentally find its way to the atmospheric pressure side of the compressor.

Without limitation, dry fluid seal system 130 may involve a tandem seal configuration involving stationary and rotatable sealing elements. Dry fluid seal system 130 may be disposed at a radially-outward segment of rotor shaft 104 and, as suggested above, may be used to provide a venting outlet 132 to fluid that otherwise would leak from chamber 111 to space 110. In one non-limiting embodiment, conduit 114 is fluidly connected to dry fluid seal system 130 to inhibit passage of the fluid to the atmospheric pressure side of the turbomachine. In one non-limiting embodiment, leak detector 112 (FIG. 1) may be a mass flow rate meter that measures a mass flow rate variation in the venting outlet of the dry seal system 130. In one example application, the venting outlet 132 may be fluidly connected to a disposal system used in connection with dry fluid seal system 130 for disposal of the fluid, such as a flare system, where the fluid may be disposed by way of combustion.

In one non-limiting embodiment, a potential malfunction that may arise in connection with dry fluid seal system 130 may be evaluated based on a condition of the first O-ring 120. For example, if the potential malfunction occurs while the first O-ring 120 is in a first condition, (e.g., an intact condition of first O-ring 120, as shown in FIG. 2), then the potential malfunction is indicative of a true malfunction in connection with the dry fluid seal system 130. That is, the first condition of first O-ring 120 is indicative of a true malfunction of the dry fluid seal system.

Figure 4:
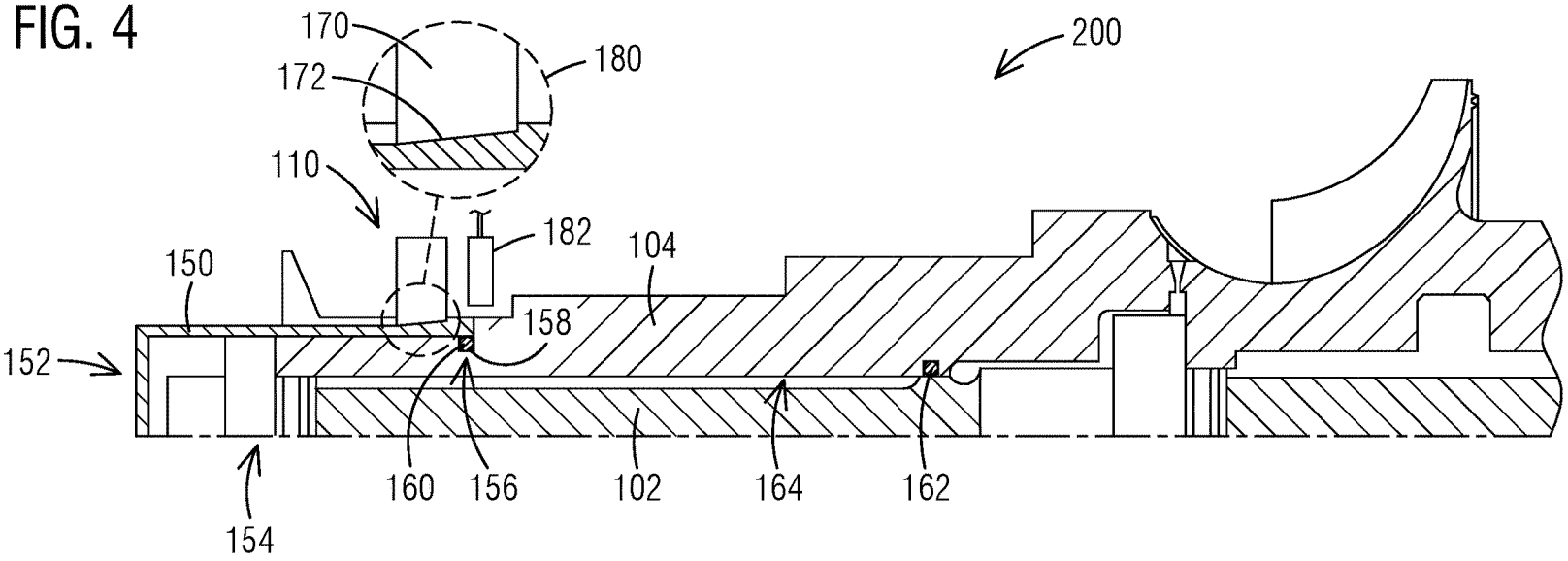
FIG. 4 illustrates a fragmentary, cross-sectional view of one non-limiting embodiment of a disclosed rotor structure involving a cap that encloses an end portion of a tie bolt.

By way of comparison, if the potential malfunction occurs while the first O-ring 120 is in a second condition, (e.g., a ruptured first O-ring 120, as schematically shown in FIG. 3), then the potential malfunction is indicative of a false malfunction in connection with dry fluid seal system 130. Therefore, still another non-limiting functionality that may be provided by this embodiment of seal assembly 108 is providing indications useful to identify root causes of non-conformance that can develop in connection with the dry fluid seal system. That is, the second condition of first O-ring 120 is indicative of a false malfunction of the dry fluid seal system FIG. 4 illustrates a fragmentary, cross-sectional view of another non-limiting embodiment of a disclosed rotor structure 200. In this example, the seal assembly involves a cap 150 having a closed end 152 that encloses an end portion 154 of tie bolt 102 that absent the cap would be in the atmospheric pressure side of the compressor. In one non-limiting embodiment, cap 150 extends axially away from the closed end 152 to an open end 156 of cap 150 that admits a portion of the rotor shaft 104.

In one non-limiting embodiment, rotor shaft 104 may include a groove 158 configured to receive an O-ring 160 circumferentially disposed about rotor shaft 104 to seal the open end 156 of cap 150. A further O-ring 162 may be circumferentially disposed about rotor shaft 104 to provide an initial sealing point to fluid that, if left unimpeded by O-ring 162, would flow from the pressurized process side of the compressor towards the end portion 154 of tie bolt 102, such as by way of a space 164, e.g., clearance gap, between tie bolt 102 and rotor shaft 104. In this embodiment, space 164 at least in part constitute the chamber separated by the seal assembly (e.g., made up in this embodiment by cap 150 and O-rings 156, 162) from first space 110.

In one non-limiting embodiment, a thrust collar 170 may be connected to cap 150 to circumferentially engage the open end 156 of cap 150 so that, for example, the portion of the rotor shaft 104 abutting the open end 156 of cap 150 is engaged by way of a circumferential compressive force provided by thrust collar 170. That is, the open end 156 of cap 150 may be compressively affixed to the abutting portion of the rotor shaft 104. In one non-limiting embodiment, a surface 172 of the trust collar 170 that engages the open end 156 of cap 150 has a frustoconical shape, as may be appreciated in zoomed-in view 180.

In this embodiment, first space 110 may be at the atmospheric pressure side of the turbomachine, and a leak detector 182, such as a pressure-measuring device to detect a cyclical pressure variation, and/or a gas-monitor probe, may be disposed proximate the open end of the cap to generate the indication of leakage of the fluid, in the event O-rings 160 and 162, each malfunctions. For example, presuming an orifice develops at a certain circumferential location of O-ring 160, then during each revolution of the rotor, the pressure-measuring device would sense a pressure increase due to leakage of the process fluid through such orifice. Similarly, the gas-monitor probe may be selected to detect the presence of certain molecules present in the process fluid and this detection would provide an indication of leakage of fluid from the open end of the cap.

Figure 5:
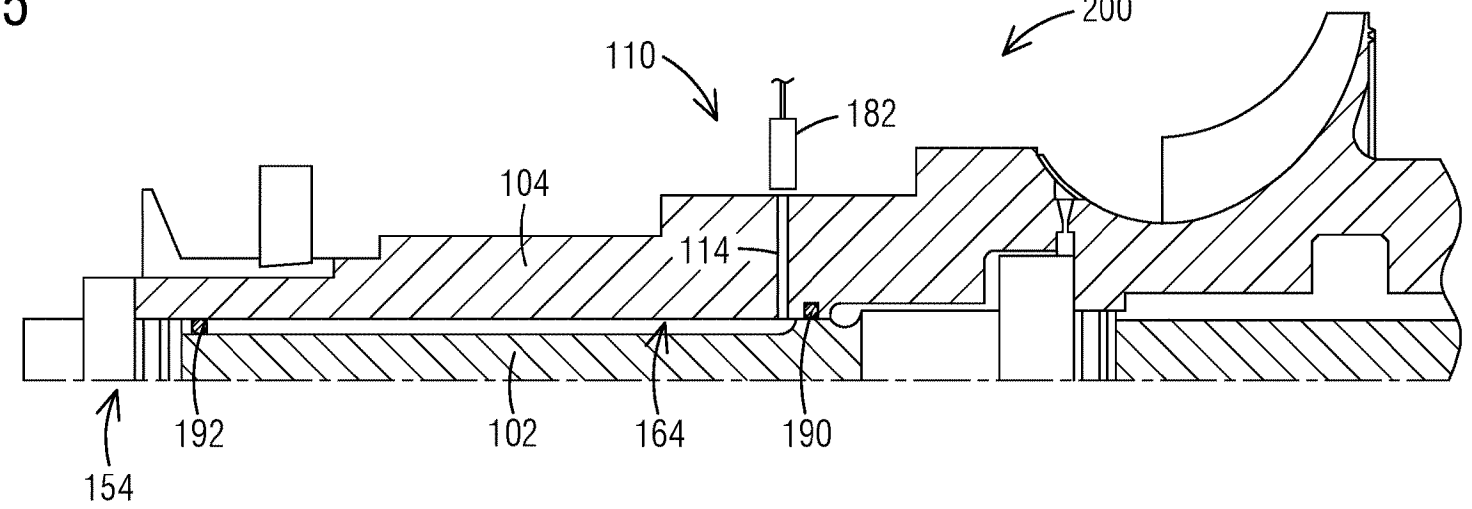
FIG. 5 illustrates a fragmentary, cross-sectional view of another non-limiting embodiment of a disclosed rotor structure.

As can be appreciated in FIG. 5, in certain embodiments not involving a cap (e.g., cap 150 FIG. 4) to enclose the end portion 154 of tie bolt 102, the seal assembly may involve a first O-ring 190 circumferentially disposed about rotor shaft 104 to provide an initial sealing point to fluid that absent first O-ring 190 would pass from the pressurized process side of the turbomachine towards the end portion 154 of tie bolt 102 by way of space 164 between tie bolt 102 and rotor shaft 104. In this embodiment, a second O-ring 192, circumferentially disposed about rotor shaft 104 proximate the end portion 154 of tie bolt 102, provides a backup functionality so that the fluid does not escape to the atmospheric pressure side of the turbomachine. In this embodiment, conduit 114 may be fluidly connected to pass the fluid to, for example, first space 110, which in this case may be at the pressurized process side of the turbomachine. In this example, leak detector 182, such as a pressure-measuring device to detect cyclical pressure variation and/or a gas-monitor probe, may be disposed proximate the exit of conduit 114 to generate the indication of leakage of the fluid, in the event O-ring 190 malfunctions.

Figure 6:
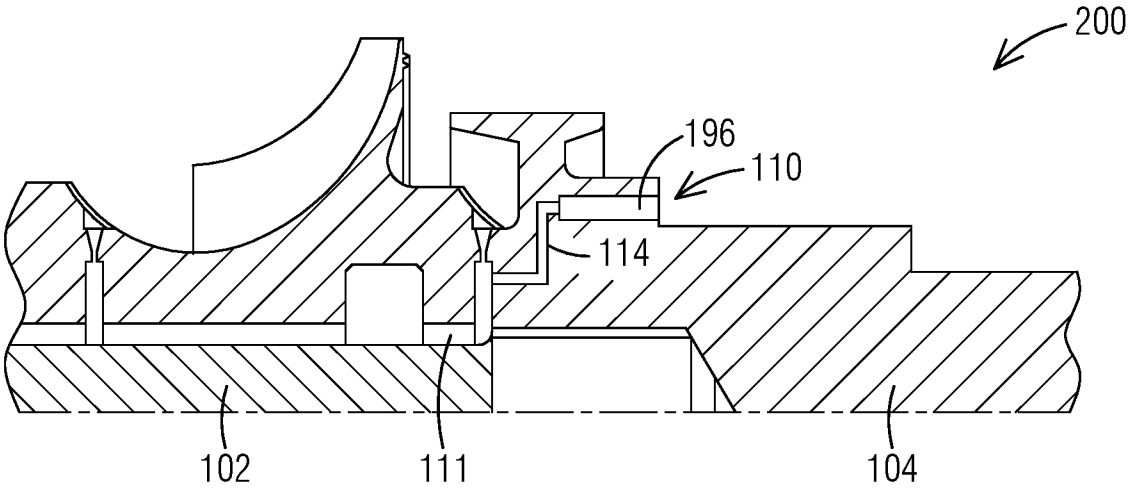
FIGS. 6 and 7 illustrate respective fragmentary, cross-sectional views of further non-limiting embodiments of a disclosed rotor structure.
Figure 7:
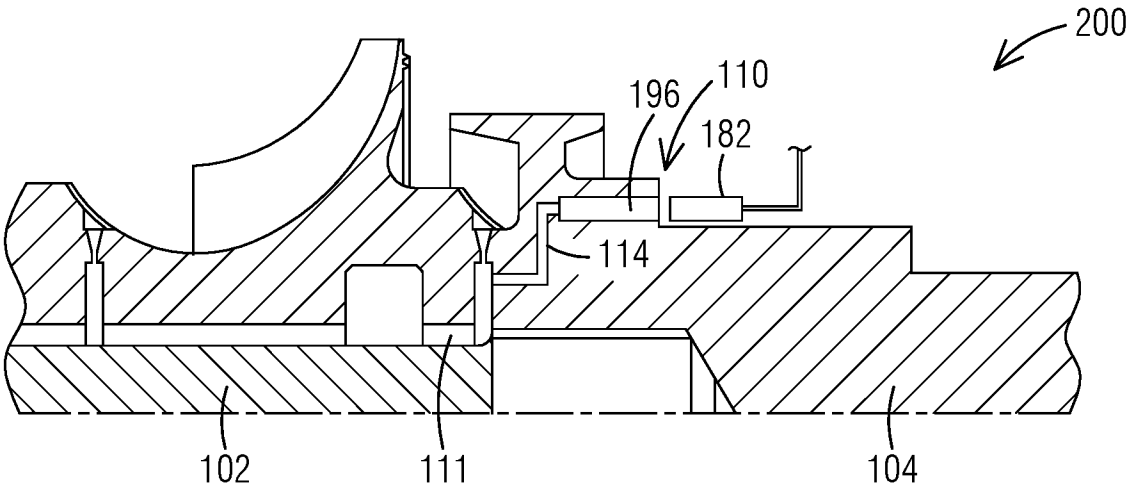

In one non-limiting embodiment, as shown in FIGS. 6 and 7, a seal assembly 196, such as a pressure-release valve or a rupture disc, may be positioned in conduit 114 and may be fluidly connected to chamber 111 to pass leakage fluid to first space 110, which may be at the pressurized process side of the turbomachine. Pressure release valve or rupture disc would be normally in a closed condition and thus normally either of these elements would function as a seal. An open condition would occur in pressure release valve or rupture disc only when the pressure in chamber 111 exceeds a predefined pressure level sufficient to set the pressure-release valve or the rupture disc to an open condition. The idea is to provide a desired path to leakage of fluid while protecting components of the turbomachinery from excessive pressure surges that can develop during operation of the turbomachine. In certain embodiments, the pressure-release valve or the rupture disc may be arranged to provide an acoustic signal (e.g., one or more frequencies that, for example, produce a whistle sound) indicative of leakage of the fluid. As shown in FIG. 7, in certain embodiments, leak detector 182, such as a pressure-measuring device to detect cyclical pressure variation and/or a gas-monitor probe may be optionally disposed in first space 110 proximate the outlet of pressure-release valve or rupture disc to provide alternative (or further) modalities of detection of leakage of the fluid.

Figure 8:
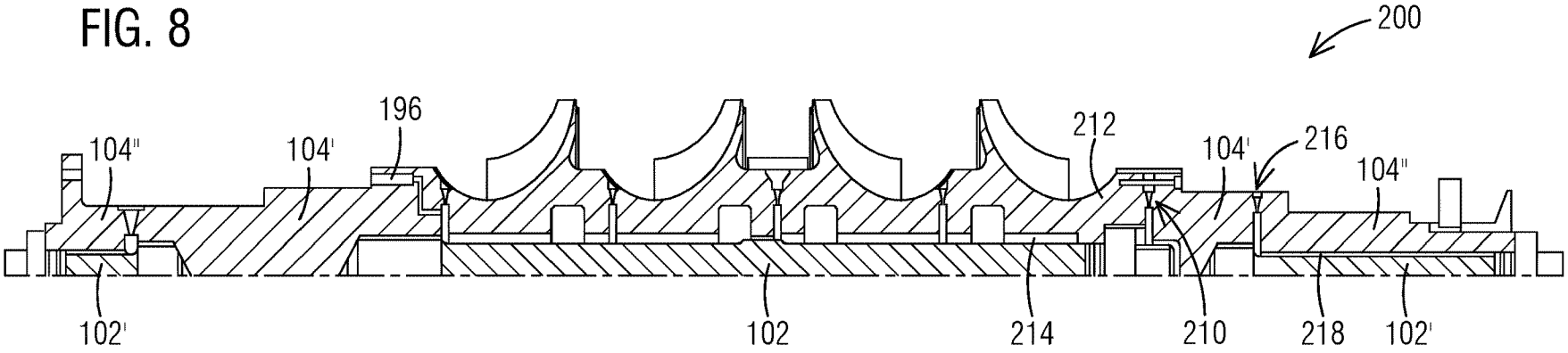
FIGS. 8 and 9 illustrate respective fragmentary, cross-sectional views of additional non-limiting embodiments of a disclosed rotor structure.
Figure 9:
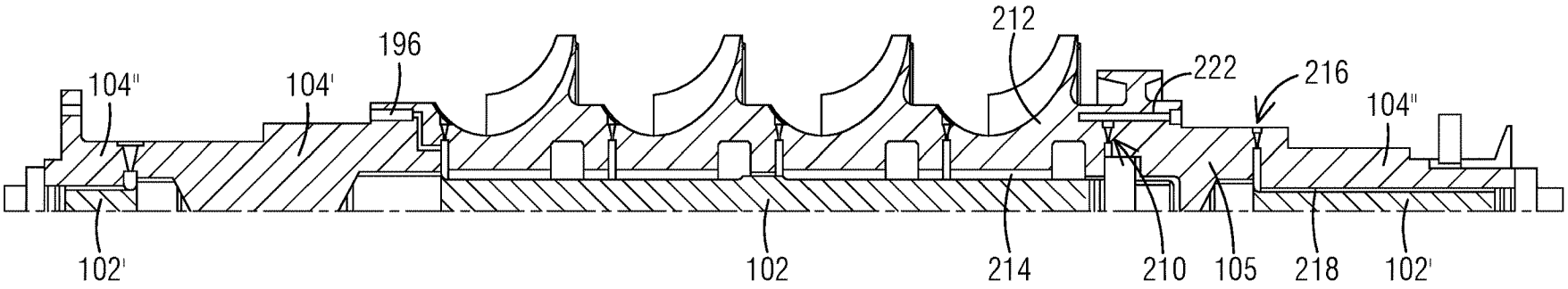

In one non-limiting embodiment, as shown in FIGS. 8 and 9, respective rotor sections may be adapted to fully impede flow of leakage fluid to the atmospheric pressure side of the turbomachine. By way of example, FIG. 8 illustrates a center-hung configuration of back-to-back, impeller compression stages supported by a first tie bolt 102. In this embodiment, an intermediate rotor shaft section 104', which may be mechanically coupled via a bolted Hirth joint 210 to an adjacent impeller body 212, provides a hermetic seal with respect to a first space 214 that may be formed about first tie bolt 102. Intermediate rotor shaft section 104' may in turn be mechanically coupled to an end rotor shaft section 104" via a Hirth joint 216. End rotor shaft section 104" is mechanically supported by a second tie bolt 102' in communication with the atmospheric pressure side of the turbomachine. A second space 218 that may be formed between end rotor shaft section 104" and second tie bolt 102' is completely fluidly decoupled from space 214. Similar sealing approach may be used, at an opposite end of first tie bolt 102. Seal assembly 196, e.g., pressure release valve or rupture disc, may be used, as discussed above, to avoid excessive pressure surges and return leakage fluid to the pressurized process side of the turbomachinery.

FIG. 9 illustrates a straight-through configuration of impeller compression stages supported by first tie bolt 102. In this example, a balance piston 222, which is mechanically coupled via a bolted Hirth joint 210 to an adjacent impeller body 212, provides a hermetic seal with respect to space 214 formed about first tie bolt 102. Balance piston 222 is in turn mechanically coupled to end rotor shaft section 104" via a Hirth joint 216. End rotor shaft section 104" is mechanically supported by second tie bolt 102' in communication with the atmospheric pressure side of the turbomachine. Space 218 that is formed between end rotor shaft section 104" and second tie bolt 102' is completely fluidly decoupled from space 214. As discussed above, a similar sealing approach may be used, at an opposite end of first tie bolt 102. Once again, seal assembly 196, e.g., pressure release valve or rupture disc, may be used to avoid excessive pressure surges and return leakage fluid to the pressurized process side of the turbomachinery.

In operation, disclosed embodiments permit appropriately sealing and guiding safely out of the rotor leakage of process fluid that may develop during operation of the compressor. In operation, disclosed embodiments can inhibit the flow of leakage fluid to, for example, an atmospheric pressure side of the compressor and can guide the flow of leakage fluid to a desired location, where the leakage can be detected by way of a leak detector. In operation, certain disclosed embodiments may use a seal assembly to provide indications useful to identify root causes of non-conformance that can develop in connection with a dry fluid seal system.

What is claimed is:

1. A rotor structure in a turbomachine, the rotor structure comprising:

a tie bolt;

a rotor shaft cooperating with the tie bolt to define a chamber therebetween;

a seal assembly positioned to separate the chamber from a first space; and a leak detector in fluid communication with the first space and operable to generate a signal indicative of leakage of a fluid from the chamber to the first space.

2. The rotor structure of claim 1, wherein the rotor shaft defines a conduit therethrough, the conduit fluidly connected to the chamber to pass the fluid to the first space.

3. The rotor structure of claim 1, wherein the seal assembly comprises a first O-ring circumferentially disposed about the rotor shaft, the first O-ring disposed at a first pressure side of the chamber.

4. The rotor structure of claim 3, wherein the seal assembly further comprises a second O-ring circumferentially disposed about the rotor shaft, the second O-ring disposed at a second pressure side of the chamber.

5. The rotor structure of claim 4, wherein the first pressure side is subject to a higher pressure compared to a pressure to which the second pressure side is subject to.

6. The rotor structure of claim 1, further comprising a dry fluid seal system positioned about a radially-outward segment of the rotor shaft to separate a pressurized process side of the turbomachine from an atmospheric pressure side of the turbomachine, wherein the conduit is fluidly connected to the dry fluid seal system to inhibit passage of the fluid to the atmospheric pressure side of the turbomachine.

7. The rotor structure of claim 6, wherein a potential malfunction in connection with the dry fluid seal system is evaluated based on a condition of the first O-ring, wherein a first condition of the first O-ring is indicative of a true malfunction of the dry fluid seal system.

8. The rotor structure of claim 7, wherein a second condition of the first O-ring is indicative of a false malfunction of the dry fluid seal system.

9. The rotor structure of claim 8, wherein the first condition corresponds to a ruptured first O-ring, and the second condition corresponds to an intact first O-ring.

10. The rotor structure of claim 6, wherein the leak detector comprises a mass flow rate meter that measures a mass flow rate variation in a venting outlet of the dry fluid seal system fluidly connected to the conduit.

11. The rotor structure of claim 1, wherein the seal assembly comprises a cap having a closed end that encloses an end portion of the tie bolt, wherein the cap extends axially away from the closed end to an open end of the cap that admits a portion of the rotor shaft, wherein the rotor shaft includes a groove configured to receive an O-ring circumferentially disposed about the rotor shaft to seal the open end of the cap.

12. The rotor structure of claim 11, wherein the cap comprises a cylindrical structure.

13. The rotor structure of claim 11, further comprising a thrust collar connected to the cap to circumferentially engage the open end of the cap, wherein the open end of the cap is compressively affixed to the portion of the rotor shaft by way of circumferential compressive force provided by the thrust collar.

14. The rotor structure of claim 13, wherein a surface of the trust collar that engages the open end of the cap has a frustoconical shape.

15. The rotor structure of claim 11, wherein the first space is at an atmospheric pressure side of the turbomachine, and the leak detector comprises at least one of the following: a pressure-measuring device that detects a cyclical pressure variation proximate the open end of the cap, and a gas-monitor probe disposed proximate the open end of the cap.

16. The rotor structure of claim 1, wherein the seal assembly comprises a pressure-release valve or a rupture disc disposed in a conduit through the rotor shaft, the conduit fluidly connected to the chamber to pass the fluid to the first space.

17. The rotor structure of claim 16, wherein the pressure-release valve or the rupture disc is operable to generate an acoustic indication of leakage of the fluid.

18. The rotor structure of claim 1, wherein the leak detector comprises at least one of the following: a pressure-measuring device that detects a cyclical pressure variation proximate an outlet of the conduit, and a gas-monitor probe disposed proximate the outlet of the conduit.

19. The rotor structure of claim 1, wherein the turbomachine is a centrifugal compressor.

20. The rotor structure of claim 1, wherein the tie bolt comprises a first tie bolt, wherein a rotor section of the turbomachine defines a cap that encloses an end portion of the first tie bolt, wherein the tie bolt further comprises a second tie bolt in communication with the atmospheric pressure side of the turbomachine, wherein a first space formed about the first tie bolt is fluidly decoupled by way of the cap defined by the rotor section of the turbomachine from a second space formed between the second tie bolt and an end rotor shaft section mechanically coupled to the rotor section of the turbomachine that defines the cap.

21. The rotor structure of claim 20, wherein the rotor section of the turbomachine that defines the cap is an intermediate rotor shaft section or is a balance piston.

22. A method comprising:

arranging in a turbomachine a tie bolt to cooperate with a rotor shaft to define a chamber therebetween;

positioning a seal assembly to separate the chamber from a first space;

fluidly connecting a conduit to the chamber to pass leakage of a fluid from the chamber to the first space, the conduit being defined through the rotor shaft, wherein the seal assembly comprises a first O-ring circumferentially disposed about the rotor shaft, the first O-ring disposed at a first pressure side of the chamber, wherein the seal assembly further comprises a second O-ring circumferentially disposed about the rotor shaft, the second O-ring disposed at a second pressure side of the chamber;

positioning a dry fluid seal system about a radially-outward segment of the rotor shaft between a pressurized process side of the turbomachine and an atmospheric pressure side of the turbomachine;

fluidly connecting the conduit to the dry fluid seal system to inhibit passage of the fluid to the atmospheric pressure side of the turbomachine; and evaluating a potential malfunction in connection with the dry fluid seal based on a condition of the first O-ring, wherein a first condition of the first O-ring is indicative of a true malfunction of the dry fluid seal system, wherein a second condition of the first O-ring is indicative of a false malfunction of the dry fluid seal system, wherein the first condition corresponds to an intact first O-ring, and the second condition corresponds to a ruptured first O-ring.

23. The method of claim 22, wherein the first pressure side is subject to a higher pressure compared to a pressure to which the second pressure side is subject to.

* * * * *